US012364310B2

(12) United States Patent
Cheney et al.

(10) Patent No.: US 12,364,310 B2
(45) Date of Patent: Jul. 22, 2025

(54) RAPID-ENTRY FOOTWEAR HAVING A HEEL ARM AND A RESILIENT MEMBER

(71) Applicant: FAST IP, LLC, Lindon, UT (US)

(72) Inventors: Craig Cheney, Lindon, UT (US); Joseph Eddington, American Fork, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 18/144,850

(22) Filed: May 9, 2023

(65) Prior Publication Data

US 2023/0276897 A1 Sep. 7, 2023

Related U.S. Application Data

(63) Continuation of application No. 17/406,430, filed on Aug. 19, 2021, now Pat. No. 11,659,886, which is a continuation of application No. PCT/US2020/019943, filed on Feb. 26, 2020.

(60) Provisional application No. 62/810,828, filed on Feb. 26, 2019.

(51) Int. Cl.
*A43B 11/00* (2006.01)
*A43B 23/02* (2006.01)

(52) U.S. Cl.
CPC ..... *A43B 11/00* (2013.01); *A43B 23/027* (2013.01)

(58) Field of Classification Search
None
See application file for complete search history.

(56) References Cited

U.S. PATENT DOCUMENTS

| | | | | |
|---|---|---|---|---|
| 287,312 | A | 10/1883 | Packard | |
| 863,549 | A * | 8/1907 | Peabody | A43B 23/28 36/58.5 |
| 1,686,175 | A * | 10/1928 | Read | A43B 3/101 36/58.5 |
| 2,083,390 | A | 6/1937 | Murena | |
| 2,118,019 | A | 5/1938 | Benjafield | |
| 2,297,594 | A | 9/1942 | Weinstat | |
| 2,693,039 | A | 11/1954 | Balut | |
| 3,014,288 | A | 12/1961 | Evans et al. | |
| 3,040,454 | A | 6/1962 | Topper et al. | |
| 3,097,438 | A | 7/1963 | Evans | |
| 3,192,651 | A | 7/1965 | Smith | |
| 3,373,512 | A | 3/1968 | Jacobson | |
| 3,643,350 | A | 2/1972 | Paoletta et al. | |
| 3,798,802 | A | 3/1974 | Saunders | |
| 4,596,080 | A | 6/1986 | Benoit et al. | |
| 4,805,321 | A | 2/1989 | Tonkel | |
| 4,979,319 | A | 12/1990 | Hayes | |
| 5,090,140 | A | 2/1992 | Sessa | |
| 5,174,050 | A | 12/1992 | Gabrielli | |

(Continued)

FOREIGN PATENT DOCUMENTS

| | | |
|---|---|---|
| CN | 101991227 A | 3/2011 |
| CN | 107467775 A | 12/2017 |

(Continued)

*Primary Examiner* — Jila M Mohandesi

(57) ABSTRACT

A rapid-entry shoe having a heel arm configured to transition between a collapsed configuration, for easy donning and doffing of the shoe, and an uncollapsed configuration, for securing a foot inside the shoe, the shoe having a resilient member configured to bias the heel arm toward the uncollapsed configuration.

16 Claims, 14 Drawing Sheets

(56) References Cited

U.S. PATENT DOCUMENTS 5,257,470 A 11/1993 Auger et al.
5,259,126 A 11/1993 Rosen
5,265,353 A 11/1993 Marega et al.
5,311,678 A 5/1994 Spademan
5,351,583 A 10/1994 Szymber et al.
5,353,526 A 10/1994 Foley et al.
5,430,961 A 7/1995 Faulconer et al.
5,806,208 A 9/1998 French
5,846,063 A 12/1998 Lakic
5,983,530 A 11/1999 Chou
6,014,823 A 1/2000 Lakic
6,128,837 A 10/2000 Huang
6,170,173 B1 1/2001 Caston
6,290,559 B1 9/2001 Scott
6,321,466 B1 11/2001 Bordin et al.
6,367,171 B1 4/2002 Burt
6,470,537 B1 10/2002 Schallenkamp
6,643,954 B2 11/2003 Voswinkel
6,839,985 B2 1/2005 Bettiol
6,877,252 B2 4/2005 Wilkinson
D583,956 S 12/2008 Chang et al.
7,757,414 B2 7/2010 Tonkel
8,302,329 B2 11/2012 Hurd et al.
8,333,021 B2 12/2012 Johnson
8,745,901 B2 6/2014 Toraya
9,119,441 B2 9/2015 Frappier
9,314,067 B2 4/2016 Bock
9,351,532 B2 5/2016 Mokos
9,629,416 B2 4/2017 Rackiewicz et al.
9,635,905 B2 5/2017 Dekovic
9,717,304 B2 8/2017 Bernhard et al.
9,820,527 B2 * 11/2017 Pratt ..... A43B 23/26
9,999,278 B2 6/2018 Feinstein
10,327,515 B2 6/2019 Peyton et al.
D854,303 S 7/2019 Flanagan et al.
10,499,707 B2 12/2019 Hobson et al.
10,506,842 B2 12/2019 Pratt et al.
10,537,154 B2 1/2020 Smith et al.
10,568,382 B2 2/2020 Hatfield et al.
10,609,981 B1 4/2020 Phinney
10,617,174 B1 4/2020 Hopkins et al.
10,638,810 B1 5/2020 Cheney et al.
10,653,209 B2 5/2020 Pratt et al.
10,660,401 B1 5/2020 Pratt et al.
10,765,167 B2 9/2020 Azoulay et al.
10,791,796 B1 10/2020 Baker
10,813,405 B2 10/2020 Pratt
10,905,192 B1 2/2021 Cheney
10,912,348 B2 2/2021 Owings et al.
10,973,278 B2 4/2021 Raia
11,000,091 B1 5/2021 Kyle
11,140,941 B2 10/2021 Xanthos et al.
11,154,113 B2 10/2021 Hatfield et al.
11,172,727 B2 11/2021 Hatfield et al.
11,191,320 B2 12/2021 Happen
11,213,098 B2 1/2022 Beers et al.
11,234,482 B2 2/2022 Roser
D948,190 S 4/2022 Jury
D948,191 S 4/2022 Holmes
D949,540 S 4/2022 Jury
D949,544 S 4/2022 Witherow
D955,732 S 6/2022 Kelley
11,633,005 B2 4/2023 Pratt et al.
11,633,006 B2 4/2023 Pratt et al.
11,633,016 B2 4/2023 Orand et al.
11,659,886 B2 5/2023 Cheney et al.
11,700,916 B2 7/2023 Kilgore et al.
11,707,113 B2 7/2023 Hopkins et al.
D993,601 S 8/2023 Wang et al.
11,737,511 B2 8/2023 Cheney et al.
11,744,319 B2 9/2023 Farina
2001/0001350 A1 5/2001 Aguerre
2002/0053147 A1 5/2002 Borsoi et al.
2002/0066213 A1 6/2002 Wells
2002/0095823 A1 7/2002 Laio et al.
2002/0174568 A1 11/2002 Neiley
2004/0003517 A1 1/2004 Marvin et al.
2004/0088890 A1 5/2004 Matis et al.
2004/0111921 A1 6/2004 Lenormand
2005/0034328 A1 2/2005 Geer
2005/0066543 A1 3/2005 Rosen et al.
2005/0241189 A1 11/2005 Elkington et al.
2007/0074425 A1 * 4/2007 Leong ..... A43B 3/12 36/68
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0276492 A1 11/2008 Burnett
2008/0313929 A1 12/2008 Hoyt
2009/0090026 A1 4/2009 Mosher
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1 * 1/2011 Somerville ..... A43B 3/122 36/105
2011/0185592 A1 8/2011 Nishiwaki et al.
2011/0214313 A1 9/2011 James et al.
2011/0239489 A1 10/2011 Iuchi et al.
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0180338 A1 * 7/2012 Lin ..... A43B 9/02 36/56
2013/0160328 A1 6/2013 Hatfield et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0298687 A1 10/2014 Flinterman et al.
2014/0305005 A1 10/2014 Yeh
2014/0373396 A1 12/2014 Chang
2015/0013184 A1 1/2015 Beers
2015/0013189 A1 1/2015 Hanak et al.
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305442 A1 10/2015 Ravindran
2016/0007674 A1 1/2016 Labonte et al.
2016/0128424 A1 5/2016 Connell et al.
2016/0128429 A1 5/2016 Hatfield et al.
2016/0262492 A1 9/2016 Fujita et al.
2016/0302530 A1 10/2016 Smith et al.
2016/0374427 A1 * 12/2016 Zahabian ..... A43B 3/24 36/102
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 9/2017 Mullen
2017/0303632 A1 * 10/2017 Pratt ..... A43B 3/248
2018/0110292 A1 * 4/2018 Beers ..... A43B 11/02
2018/0199659 A1 7/2018 Lintaman
2018/0235314 A1 8/2018 Farage
2018/0255865 A1 9/2018 Hsu
2018/0263332 A1 9/2018 Bruno
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.

(56) References Cited

U.S. PATENT DOCUMENTS

| | | | |
|---|---|---|---|
| 2020/0015544 | A1 | 1/2020 | Pratt |
| 2020/0037703 | A1 | 2/2020 | Twist |
| 2020/0046066 | A1 | 2/2020 | Difrancisco |
| 2020/0068991 | A1 | 3/2020 | Steere et al. |
| 2020/0085136 | A1 | 3/2020 | Pratt et al. |
| 2020/0113274 | A1 | 4/2020 | Butler |
| 2020/0187590 | A1 | 6/2020 | Hopkins et al. |
| 2020/0196703 | A1 | 6/2020 | Hopkins |
| 2020/0196787 | A1 | 6/2020 | Dament et al. |
| 2020/0205511 | A1 | 7/2020 | Hopkins et al. |
| 2020/0205512 | A1 | 7/2020 | Blanche et al. |
| 2020/0205516 | A1 | 7/2020 | Kilgore |
| 2020/0205518 | A1 | 7/2020 | Hopkins et al. |
| 2020/0205520 | A1 | 7/2020 | Kilgore |
| 2020/0245797 | A1 | 8/2020 | Kim |
| 2020/0253333 | A1 | 8/2020 | Kilgore et al. |
| 2020/0305552 | A1 | 10/2020 | Cheney et al. |
| 2020/0323308 | A1 | 10/2020 | Dubuisson |
| 2020/0375319 | A1 | 12/2020 | Yang |
| 2020/0383424 | A1 | 12/2020 | Hughes |
| 2021/0059351 | A1 | 3/2021 | Piacentini |
| 2021/0068493 | A1 | 3/2021 | Pratt et al. |
| 2021/0068494 | A1 | 3/2021 | Zahabian |
| 2021/0068498 | A1 | 3/2021 | Cheney et al. |
| 2021/0106094 | A1 | 4/2021 | Cheney |
| 2021/0112911 | A1 | 4/2021 | Pratt et al. |
| 2021/0112914 | A1 | 4/2021 | Cheney |
| 2021/0112916 | A1 | 4/2021 | Schulten |
| 2021/0127788 | A1 | 5/2021 | Li |
| 2021/0145114 | A1 | 5/2021 | Kyle |
| 2021/0169177 | A1 | 6/2021 | Yang |
| 2021/0186146 | A1 | 6/2021 | Erwin |
| 2021/0204642 | A1 | 7/2021 | Kyle |
| 2021/0204643 | A1 | 7/2021 | Kyle |
| 2021/0204644 | A1 | 7/2021 | Kyle |
| 2021/0204645 | A1 | 7/2021 | Pratt |
| 2021/0227923 | A1 | 7/2021 | Love et al. |
| 2021/0235811 | A1 | 8/2021 | Oh |
| 2021/0282495 | A1 | 9/2021 | Davis et al. |
| 2021/0321718 | A1 | 10/2021 | Chang |
| 2021/0330033 | A1 | 10/2021 | Pratt et al. |
| 2021/0337922 | A1 | 11/2021 | Cheney |
| 2021/0345727 | A1 | 11/2021 | Raia |
| 2022/0104582 | A1 | 4/2022 | Christensen et al. |
| 2022/0132976 | A1 | 5/2022 | Bentz |
| 2022/0142291 | A1 | 5/2022 | Cheney et al. |
| 2022/0240625 | A1 | 8/2022 | Shin |
| 2022/0287406 | A1 | 9/2022 | Cheney et al. |
| 2022/0287407 | A1 | 9/2022 | Cheney et al. |
| 2022/0354220 | A1 | 11/2022 | Cheney |
| 2022/0361627 | A1 | 11/2022 | Cheney et al. |
| 2022/0369758 | A1 | 11/2022 | Pratt |
| 2022/0378144 | A1 | 12/2022 | Pratt et al. |
| 2022/0400810 | A1 | 12/2022 | Cheney et al. |
| 2023/0030016 | A1 | 2/2023 | Pratt et al. |
| 2023/0033366 | A1 | 2/2023 | Farina |
| 2023/0035573 | A1 | 2/2023 | Bar |
| 2023/0052916 | A1 | 2/2023 | Bar |
| 2023/0055164 | A1 | 2/2023 | Cheney et al. |
| 2023/0081272 | A1 | 3/2023 | Pratt |
| 2023/0084256 | A1 | 3/2023 | Brilliant |
| 2023/0218033 | A1 | 7/2023 | Cheney |
| 2023/0225450 | A1 | 7/2023 | Cheney et al. |
| 2023/0263270 | A1 | 8/2023 | Jones |
| 2023/0284737 | A1 | 9/2023 | Bar |

FOREIGN PATENT DOCUMENTS

| | | | |
|---|---|---|---|
| EP | 1952715 | A1 | 8/2008 |
| EP | 3266327 | A1 | 1/2018 |
| FR | 3066679 | A1 | 11/2018 |
| JP | 11-127907 | A | 5/1999 |
| JP | 2010-104416 | A | 5/2010 |
| JP | 2013-510685 | A | 3/2013 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| WO | 2018/230961 | A1 | 12/2018 |
| WO | 2019/215359 | A1 | 11/2019 |
| WO | 2020/006490 | A1 | 1/2020 |
| WO | 2020/176653 | A1 | 9/2020 |
| WO | 2021/162569 | A1 | 8/2021 |
| WO | 2022/221339 | A1 | 10/2022 |
| WO | 2023/049414 | A1 | 3/2023 |
| WO | 2023/064568 | A1 | 4/2023 |

* cited by examiner

RAPID-ENTRY FOOTWEAR HAVING A HEEL ARM AND A RESILIENT MEMBER

CROSS-REFERENCE TO RELATED APPLICATIONS

This application is a continuation of, claims priority to and the benefit of U.S. Ser. No. 17/406,430 filed Aug. 19, 2021 and entitled "RAPID-ENTRY FOOTWEAR HAVING A HEEL ARM AND A RESILIENT MEMBER" which is a continuation of, claims priority to and the benefit of PCT Serial No. PCT/US20/19943 filed Feb. 26, 2020 and entitled "RAPID-ENTRY FOOTWEAR HAVING A HEEL ARM AND A RESILIENT MEMBER." PCT Serial No. PCT/US20/19943 claims the benefit of U.S. Provisional Patent Application No. 62/810,828, filed Feb. 26, 2019 and entitled "RAPID-ENTRY FOOTWEAR HAVING A HEEL ARM AND A FORWARD ELASTIC PORTION." All of the aforementioned applications are incorporated herein by reference in their entireties.

FIELD

The present disclosure relates to rapid-entry footwear, and more specifically to footwear having a heel arm and a resilient member.

BACKGROUND

Whether due to inconvenience or inability, donning and doffing of shoes, including tying or otherwise securing the same, and doing the foregoing for others, may be undesirable and/or present difficulties to some individuals. The present disclosure addresses this need.

SUMMARY

A rapid-entry shoe, in accordance with example embodiments of the present disclosure, comprises a base, optionally an upper, a heel arm, and a resilient member. The heel arm can be coupled to the base at a rearward coupling point and can be configured to transition between a collapsed configuration (e.g., for easy donning and doffing of the shoe) and an uncollapsed configuration (e.g., for securing a foot inside the shoe). In the collapsed configuration the heel arm may be in a compressed state and bend or rotate downward, while in the uncollapsed configuration the heel arm can be oriented upwards and may be in an uncompressed state or a reduced compressed state. The resilient member can be coupled to the heel arm at a heel arm coupling point and can be further coupled to the base at a forward coupling point. The resilient member can be configured to bias the heel arm toward the uncollapsed configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
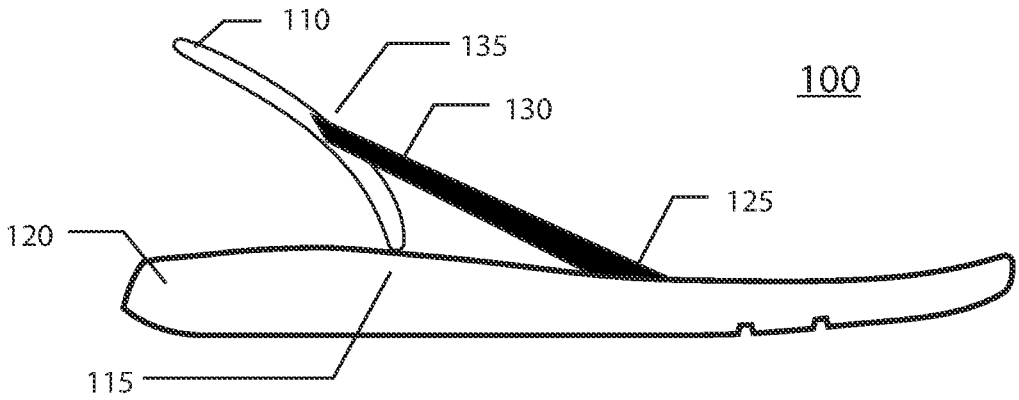
FIGS. 1A-1C illustrate a rapid-entry shoe having a heel arm and a resilient member, in accordance with various embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers, magnets and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, a "base" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe.

In various embodiments, and with reference to FIGS. 1A-1C, a rapid-entry shoe 100 includes a heel arm 110 and a resilient member 130, both of which are coupled to a base 120 (and/or upper, as described below) of the rapid-entry shoe 100. Generally, the resilient member 130 is coupled to base 120 at a location forward a location where heel arm 110 is coupled to base, and resilient member 130 thereby biases the heel arm 110 toward an uncollapsed configuration, as described in greater detail below. That is, in response to a user inserting his/her foot into the shoe, the heel arm 110 may pivot, rotate or otherwise collapse downward and/or backward, thereby tensioning (or further tensioning) the resilient member 130. With the foot inside the shoe, the tension in the resilient member 130 exerts a force on the heel arm 110 to pivot, rotate or otherwise move the heel arm 110 upward and/or forward, thereby closing the shoe opening.

While the heel arm 110 and/or the resilient member 130 are coupled to the base 120 in example embodiments, in other embodiments, the heel arm 110 and/or the resilient member 130 are not coupled to the base 120, but instead, are coupled to an upper of the rapid-entry shoe 100. That is, the heel arm 110 and/or the resilient member 130 may be coupled to a medial and/or lateral side of an upper of the rapid-entry shoe 100, with the resilient member providing the forward and upward bias described above. In various embodiments, for example, the upper may have sufficient structure to prevent forward or backward movement of the points where the heel arm 110 and resilient member 130 are coupled, thereby enabling the resilient member to provide sufficient tension to pivot, rotate or otherwise move the heel arm 110 upward and/or forward to return the shoe 100 to the uncollapsed configuration.

Turning to FIGS. 2A-2D, in example embodiments, the heel arm 110 is embedded within, extends along, forms or is otherwise coupled to a rear portion of the rapid-entry shoe 100. The heel arm 110 is coupled to the base 120 at a rearward coupling point 115, and the heel arm is configured to transition between a collapsed configuration (open position of the rapid-entry shoe 100, in which an opening of the shoe is expanded for easier donning and doffing) and an uncollapsed configuration (closed position of the rapid-entry shoe 100, in which an opening of the shoe is unexpanded for securing a foot inside the shoe). In the collapsed configuration (FIG. 2B), the heel arm 110 is in a compressed state and bends or rotates downward and in the uncollapsed configuration (FIG. 2A), the heel arm is oriented upwards (i.e., vertical or at an angle) and is in at least one of an uncompressed state, a reduced compressed state, and a partially bent state.

In example embodiments, the transition between the collapsed configuration and the uncollapsed configuration occurs without any bending or flexing of the base 120. In example embodiments, the transition between the collapsed configuration and the uncollapsed configuration occurs without any inward deflection of the heel arm 110 (e.g., around the user's heel). In example embodiments, a plurality of dimensions of the resilient member 130 change during the transition between the collapsed configuration and the uncollapsed configuration, for example, length (greater in the collapsed configuration) and width (less in the collapsed configuration).

Figure 2A:
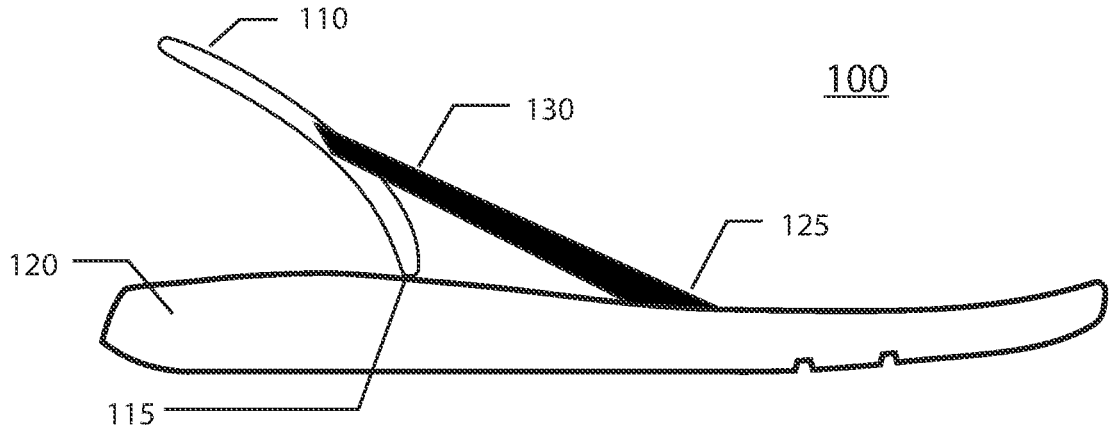
FIGS. 2A-2D illustrate alternate embodiments of example rapid-entry shoes in uncollapsed and collapsed configurations.
Figure 2B:
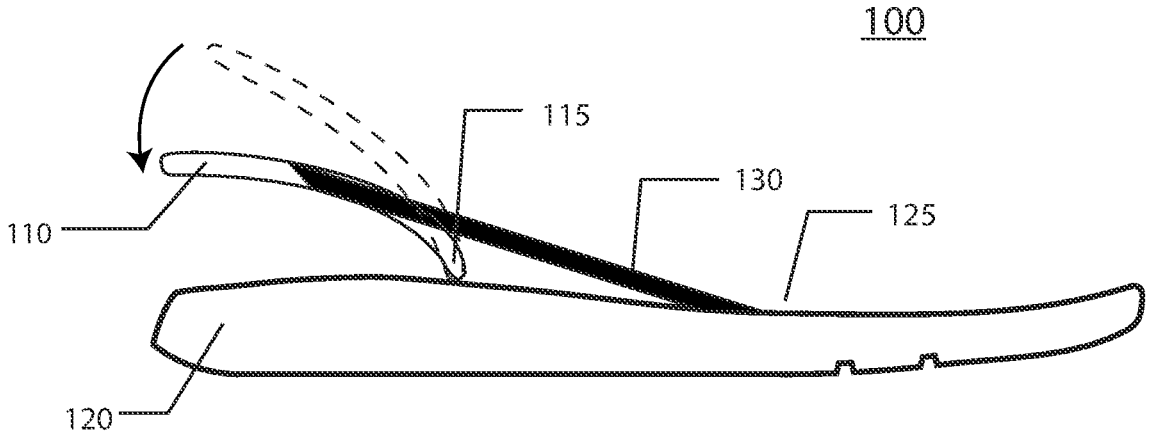
Figure 2C:
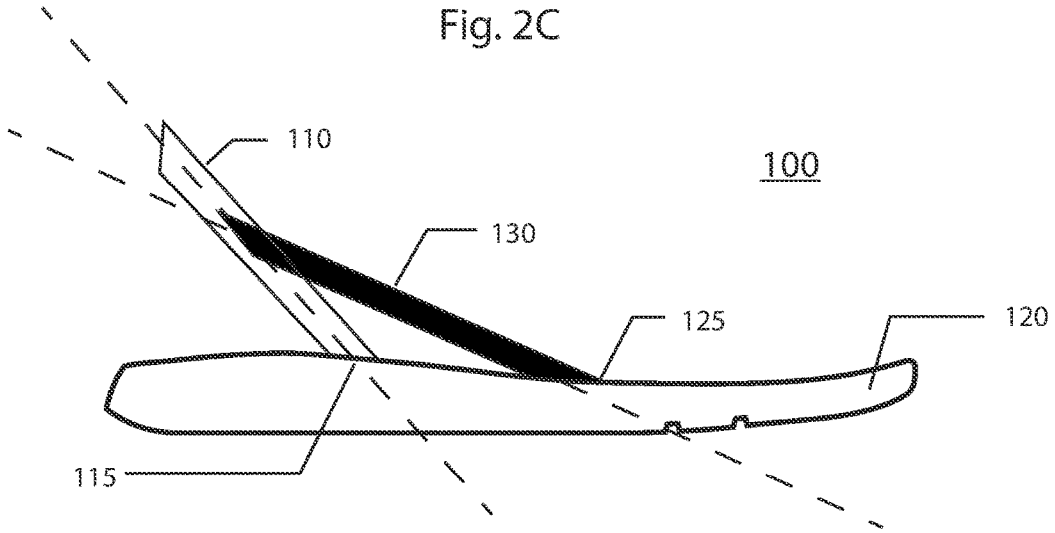

As contrasted in FIGS. 2C and 2A, respectively, heel arm 110 can extend toward a rear portion of the shoe 100 generally in a single plane (i.e., be generally linear when viewed from the side, in two dimensions), or heel arm 110 can extend toward a rear portion of the shoe 100 with a curve or angle (i.e., be generally non-linear when viewed from the side, in two dimensions).

Figure 2D:
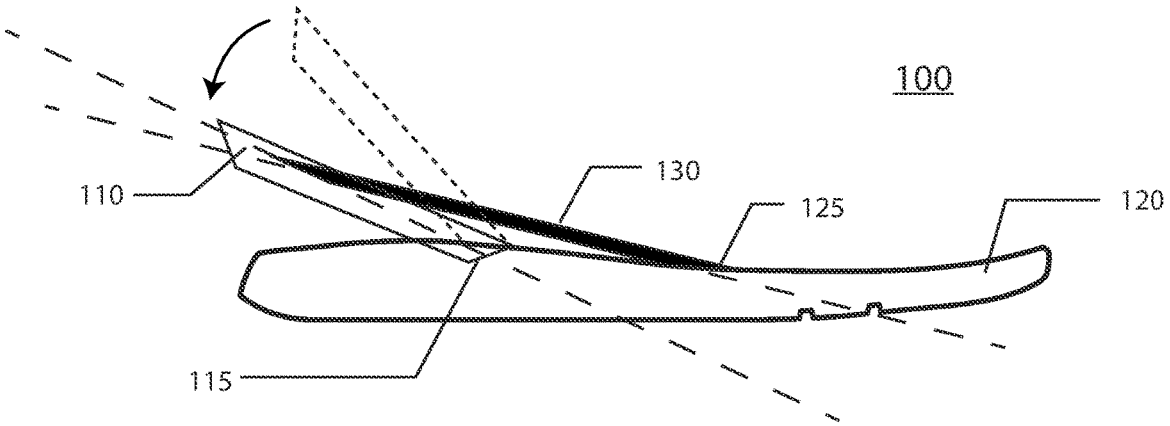

With specific reference to FIGS. 2C and 2D, and as described below, the heel arm 110 may be comprised of a rigid or semi-rigid material, so maintain its shape between an uncollapsed configuration (FIG. 2C) and a collapsed configuration (FIG. 2D).

Figure 1B:
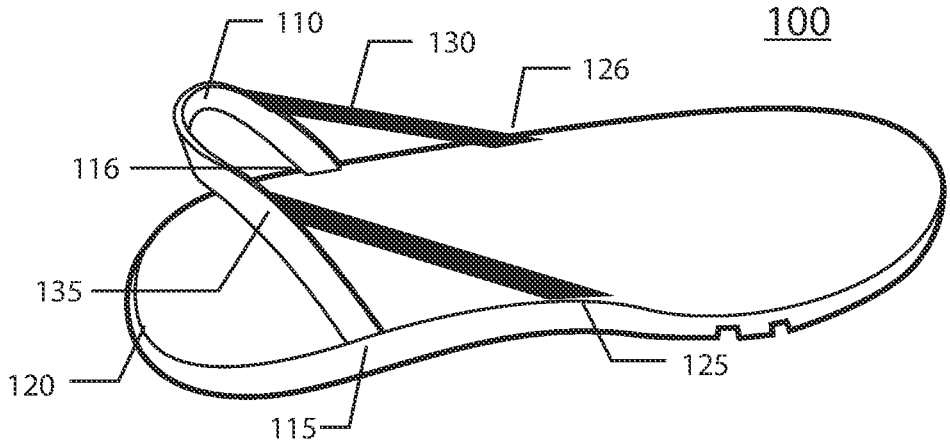
Figure 1C:
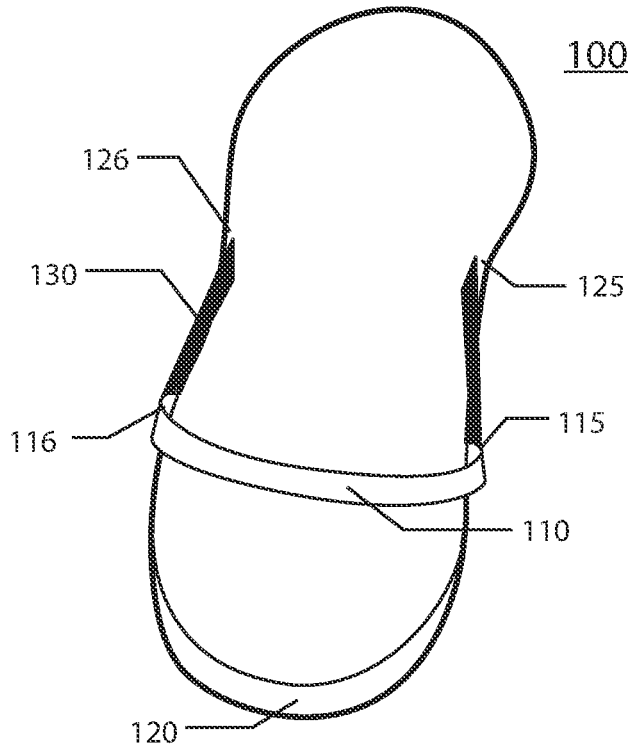

With momentary reference back to FIGS. 1A and 1B, in example embodiments, the resilient member 130 is embedded within, extends along, forms or is otherwise coupled to a side portion of the rapid-entry shoe 100. The resilient member 130 is coupled to the heel arm 110 at a heel arm coupling point 135 (and may terminate proximal such coupling point) and is further coupled to the base 120 at a forward coupling point 125 (and may terminate proximal such coupling point). The resilient member is configured to bias the heel arm 110 toward the uncollapsed configuration (closed position of the rapid-entry shoe 100).

In example embodiments, one or both of the heel arm 110 and the resilient member 130 are angled relative to the base 120. More specifically, one or both of the heel arm 110 and the resilient member 130 can be angled upward from their respective coupling points toward the rear portion of the shoe 100.

With reference back to FIG. 2C, and particularly, to the dotted lines therein, in accordance with various embodiments, in an uncollapsed configuration, an angle measured between heel arm 110 and base 120 is greater than an angle measured between resilient member 130 and base 120.

With continued reference to the dotted lines in FIGS. 2C and 2D, in accordance with various embodiments, the difference in an uncollapsed configuration of an angle measured between heel arm 110 and base 120 and an angle measured between resilient member 130 and base 120 is greater than the difference in a collapsed configuration of an angle measured between heel arm 110 and base 120 and an angle measured between resilient member 130 and base 120.

In various embodiments, the forward coupling point 125, which is the point where the resilient member 130 is coupled to the base 120, is forward of the rearward coupling point 115, which is the point where the heel arm 110 is coupled to the base 120. Said differently, in example embodiments, the resilient member 130 extends farther forward (i.e., toward the toe-end of the shoe) than the heel arm 110.

In various embodiments, the heel arm 110 has a side section and a heel section. The heel section is generally the section or piece of the heel arm 110 that is disposed at the rear of the rapid-entry shoe, and thus the heel section wraps around an upper rear portion of the rapid-entry shoe 100. The side section is generally the section or piece of the heel arm 110 that extends between the rearward coupling point and the heel arm coupling point. In various embodiments, the resilient member 130 is coupled to the heel arm 110 at a heel arm coupling point 135 substantially between the heel section and the side section. Said differently, one end of the resilient member 130 is coupled or indirectly coupled to the base 120, but the other end is coupled generally to a region of the heel arm 110 between the side section and the heel section, according to various embodiments.

As described above, the heel arm 110 may be comprised of a rigid or semi-rigid material. In various embodiment, the heel arm 110 is resiliently deformable, such that it contributes, at least in part, to the upward and/or forward rebound caused by the resilient member 130. In various embodiments, the heel arm 110, in addition to imparting structure to the rear portion of the shoe 100 and to help the rear portion of the shoe 100 rebound back upward and/or forward after a user's foot is inserted in to the shoe, the heel arm 110 may prevent the rear portion of the shoe 100 from inward deflection into the shoe/foot opening.

Figure 3A:
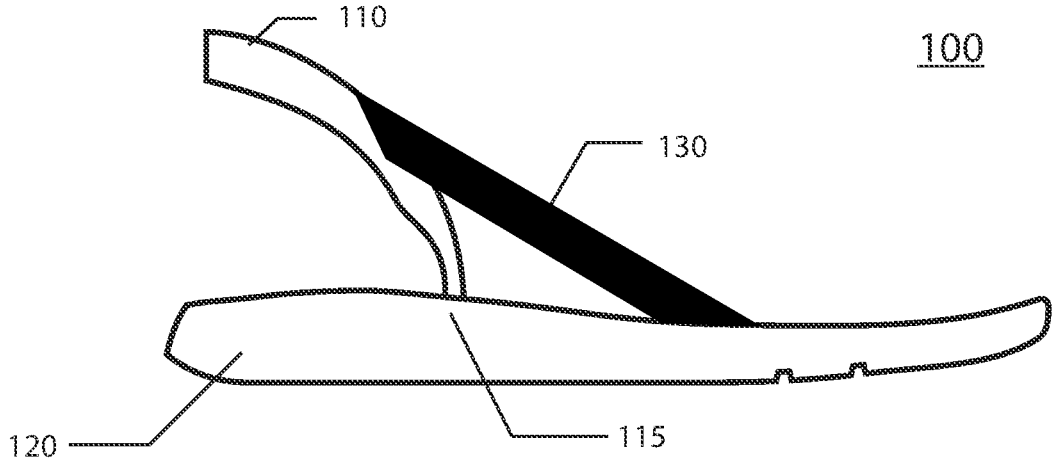
FIGS. 3A-3D illustrate living hinge connections for heel arms, in accordance with the present disclosure.
Figure 3B:
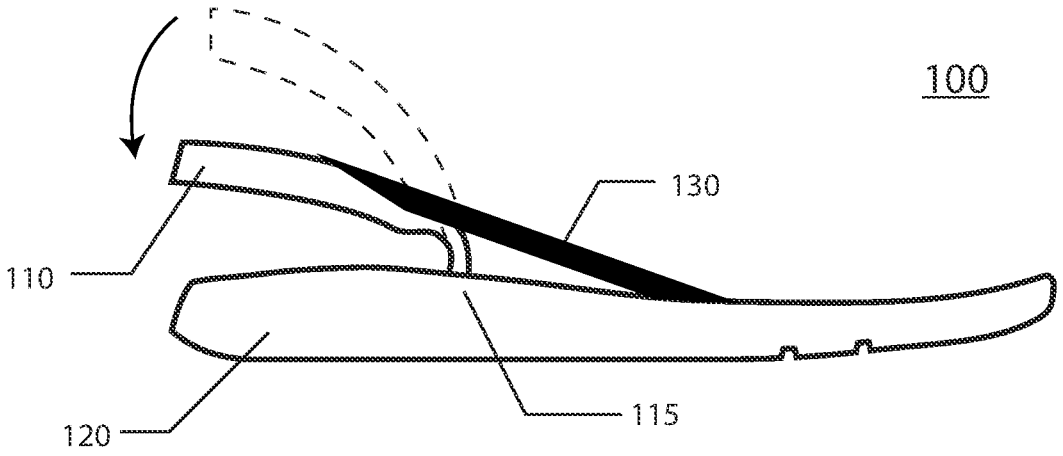
Figure 3C:
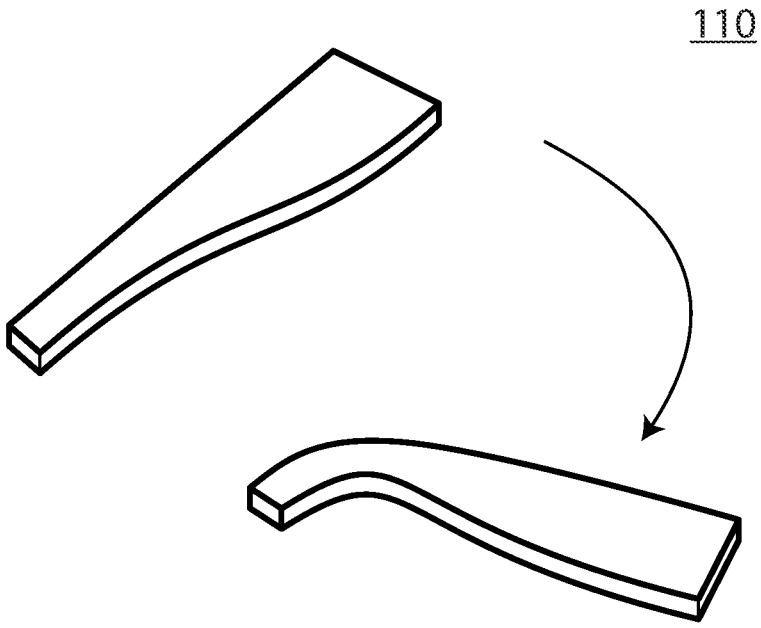

In some embodiments, and with reference to FIGS. 3A and 3B, the portion of the heel arm 110 adjacent the rearward coupling point 115 may be somewhat flexible/deformable in order to form a living hinge at the rearward coupling point 115. Stated another way, an interface between the heel arm 110 and the base 120 at the rearward coupling point 115 can comprise a living hinge. In this regard, FIG. 3C illustrates a close up view of the living hinge in FIGS. 3A and 3B. In such embodiments, the hinge movement is accommodated by a relative decrease in the thickness of the material in the plane, and at the axis, where the hinge rotation takes place.

Figure 3D:
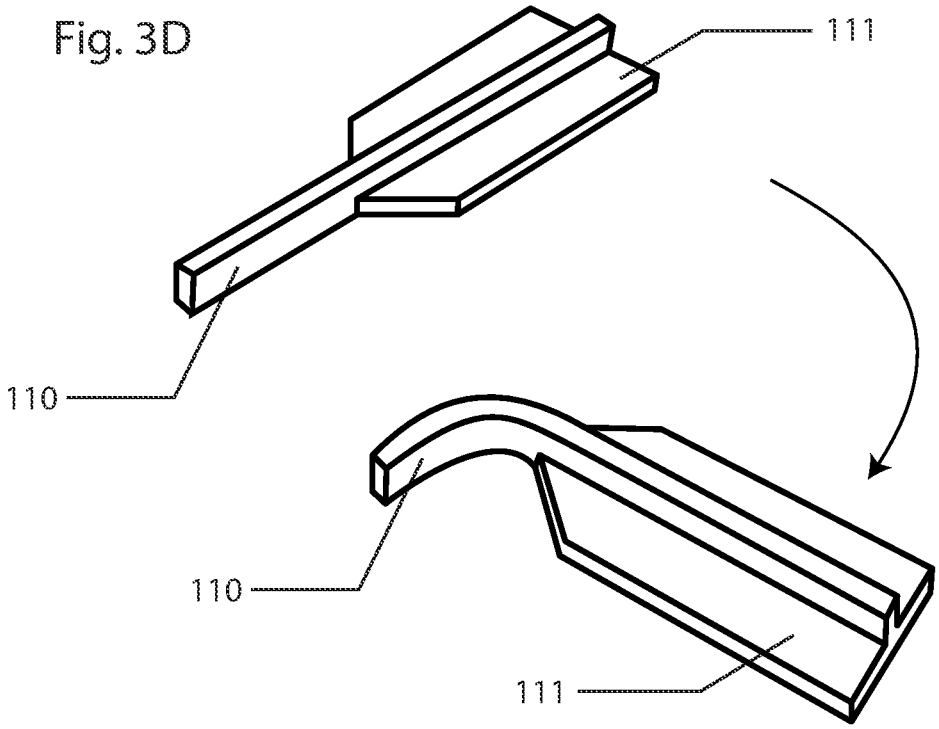

FIG. 3D illustrates an alternate embodiment of a hinge having a flange 111, wherein the hinge movement is accommodated by the addition of the flange 111 in the plane, but removed from the axis, where the hinge rotation takes place.

Figure 4A:
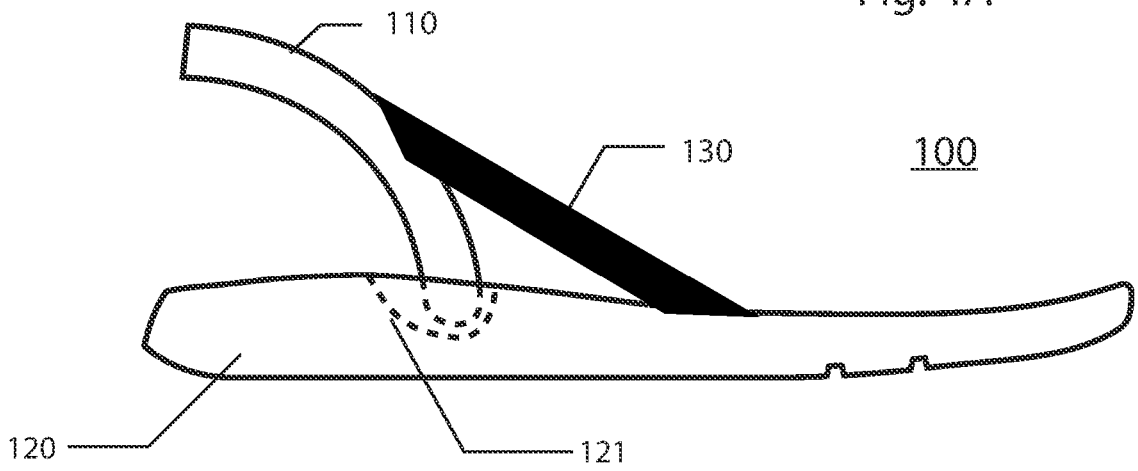
FIGS. 4A-4C illustrate socket connections for heel arms, in accordance with the present disclosure.
Figure 4B:
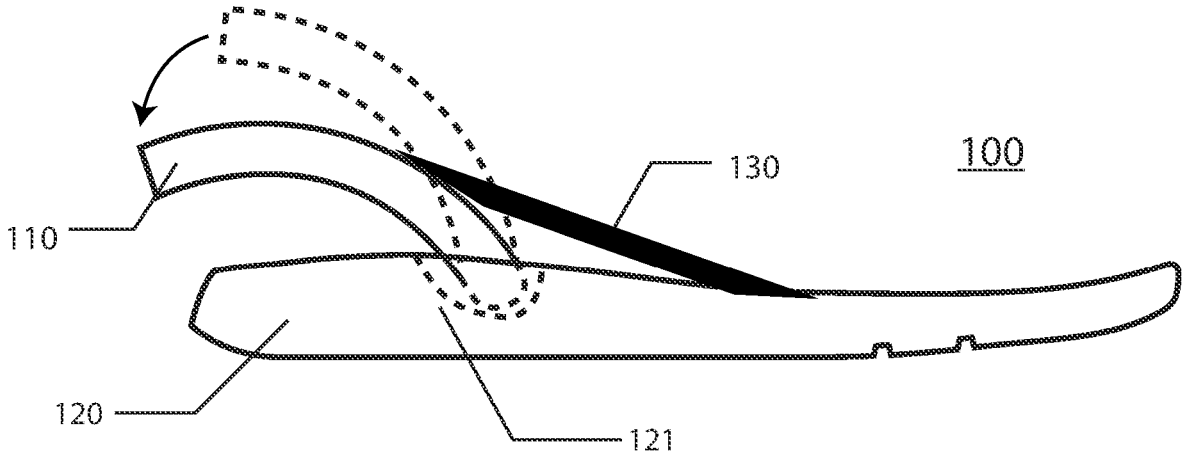

In other embodiments, the rearward coupling point 115 may include a mechanical hinge. For example, and with reference to FIGS. 4A and 4B, a base 120 can have a socket 121 to receive the end of a heel arm 110, and accommodate movement thereof between an uncollapsed configuration (FIG. 4A) and a collapsed configuration (FIG. 4B). In such embodiments, the heel arm 110 may be coupled (as that term is broadly defined herein) within the socket 121.

Figure 4C:
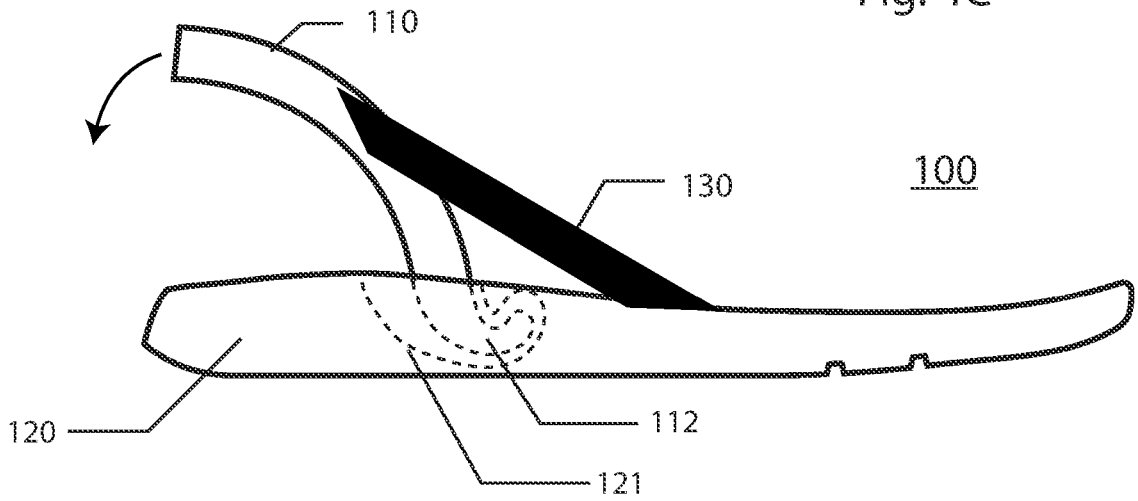

FIG. 4C illustrates another embodiment of a socket 121 to receive the end of a heel arm 110, wherein the heel arm 110 has a locking extension 112 and wherein a dimension of the socket 121 corresponds to the locking extension 112, such that the heel arm 110 is securely retained within the socket 121.

Figure 5A:
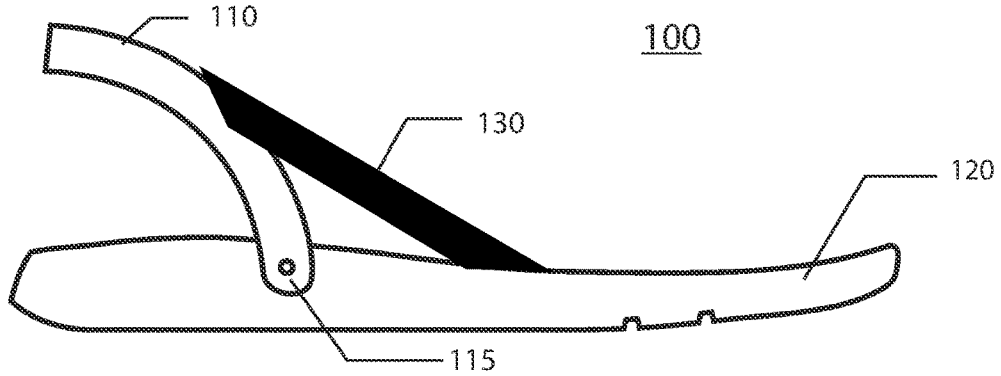
FIGS. 5A-5C illustrate hinge pin connections for heel arms, in accordance with the present disclosure.
Figure 5B:
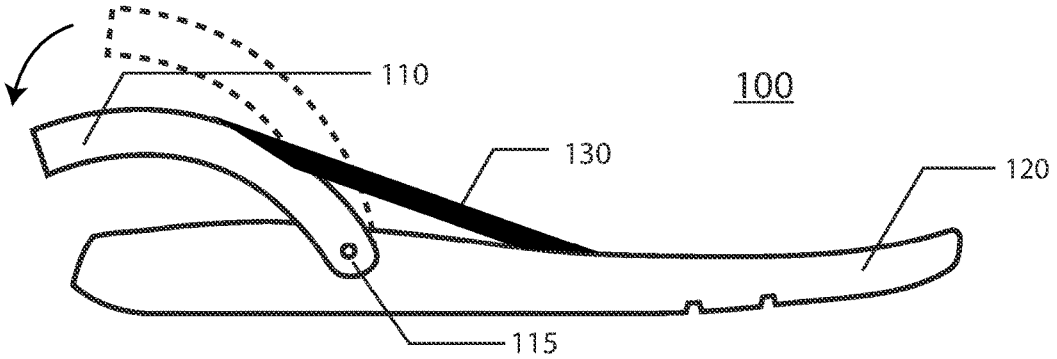
Figure 5C:
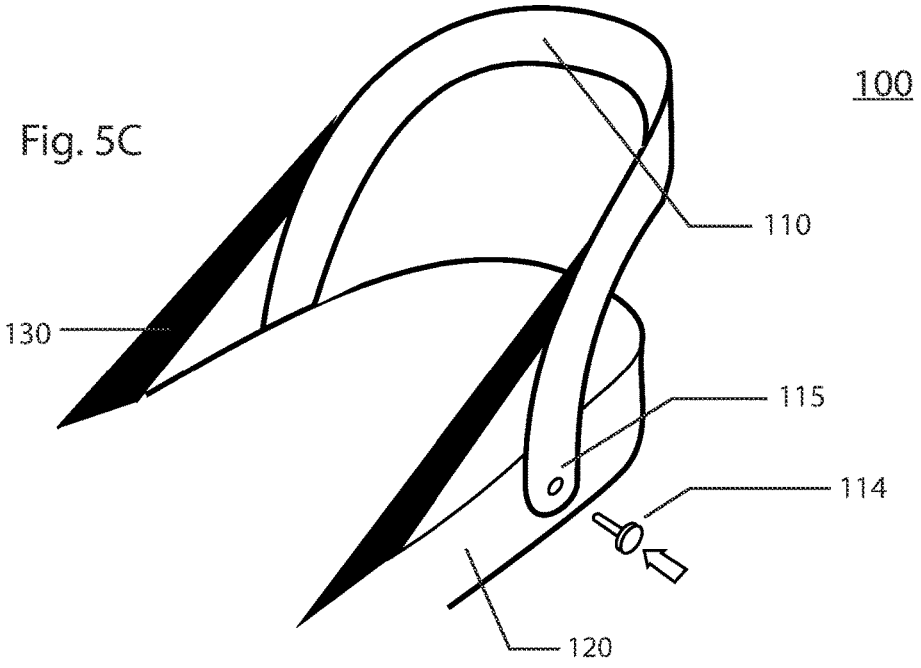

In other embodiments of mechanical hinges, and with reference to FIGS. 5A-5C, heel arm 110 can be pivotably or rotatably coupled to base 120 at the rearward coupling point 115, to thereby accommodate movement thereof between an uncollapsed configuration (FIGS. 5A and 5C) and a collapsed configuration (FIG. 5B). This can be accomplished, for example, with a hinge pin 114, as illustrated.

More generally, in accordance with example, embodiments, each of the forward coupling point 125 and the rearward coupling point 115 can be located on an exterior of a base or within a base 120 (i.e., resilient member 130 and heel arm 110 can extend into the base 120).

Importantly, in accordance with various example embodiments, the axis of rotation of heel arm 110 can extend through base 120 or above base 120 (e.g., in embodiments wherein heel arm 110 is coupled to an upper).

The resilient member 130 may be comprised of an elastic material, such as a textile or synthetic material, or may include springs or other biasing features configured to exert a forward and/or upward bias on the heel arm 110 (and a corresponding forward and/or upward bias on an upper 140 coupled to the heel arm 110).

Figure 6A:
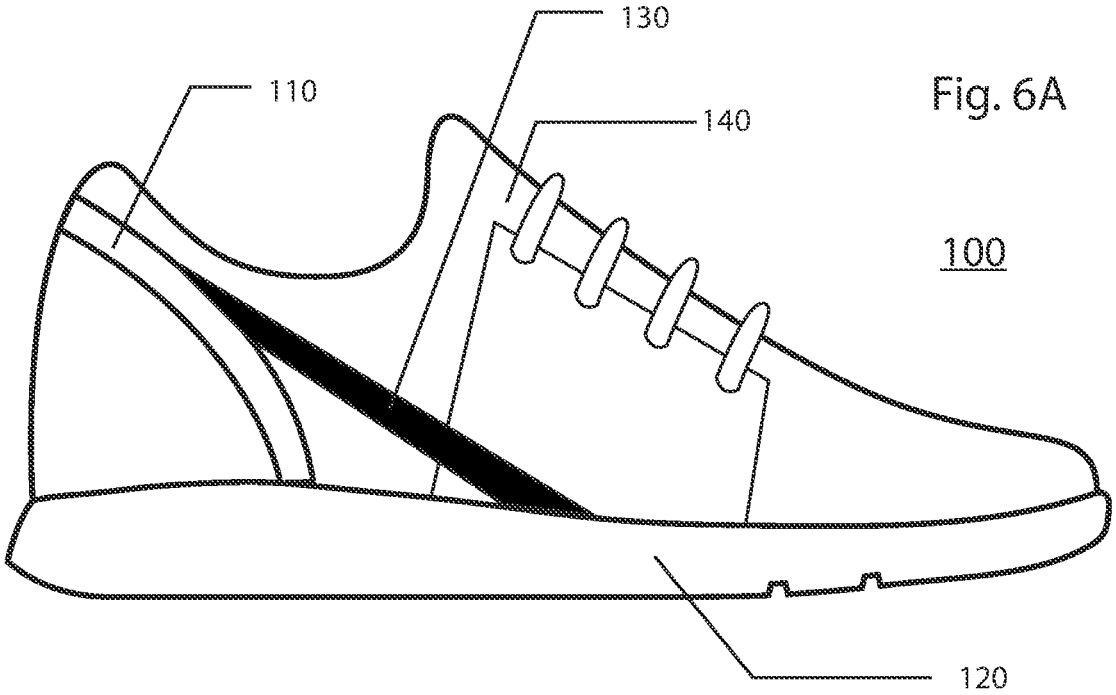
FIGS. 6A and 6B illustrate a rapid-entry shoe having an upper, in uncollapsed and collapsed configurations, in accordance with various embodiments.
Figure 6B:
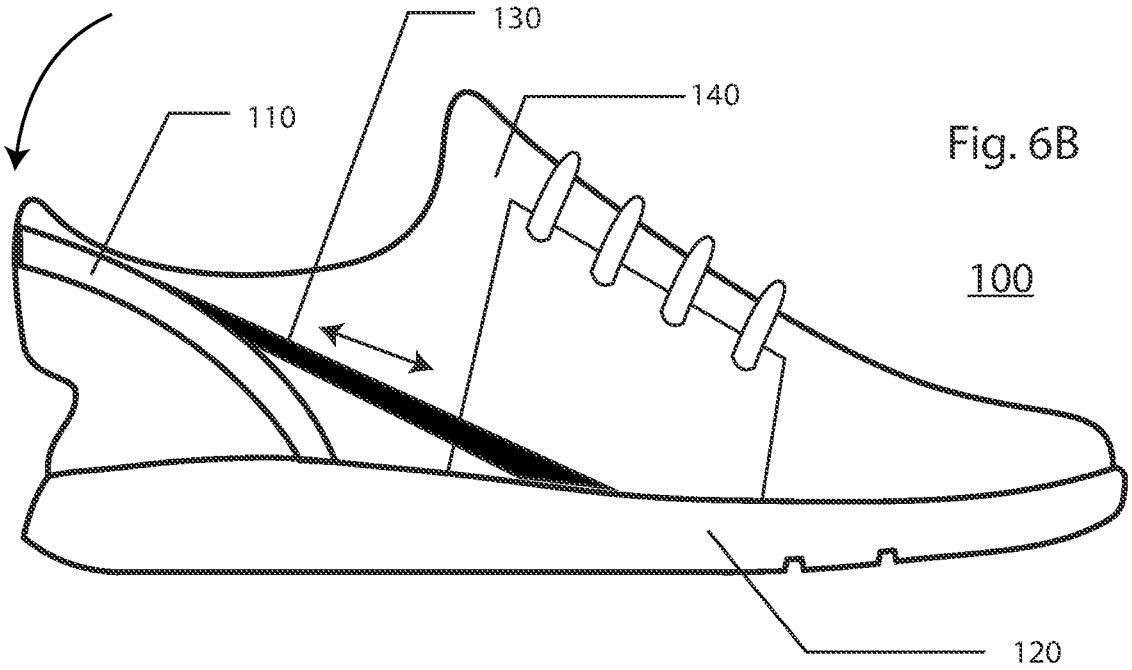
Figure 7A:
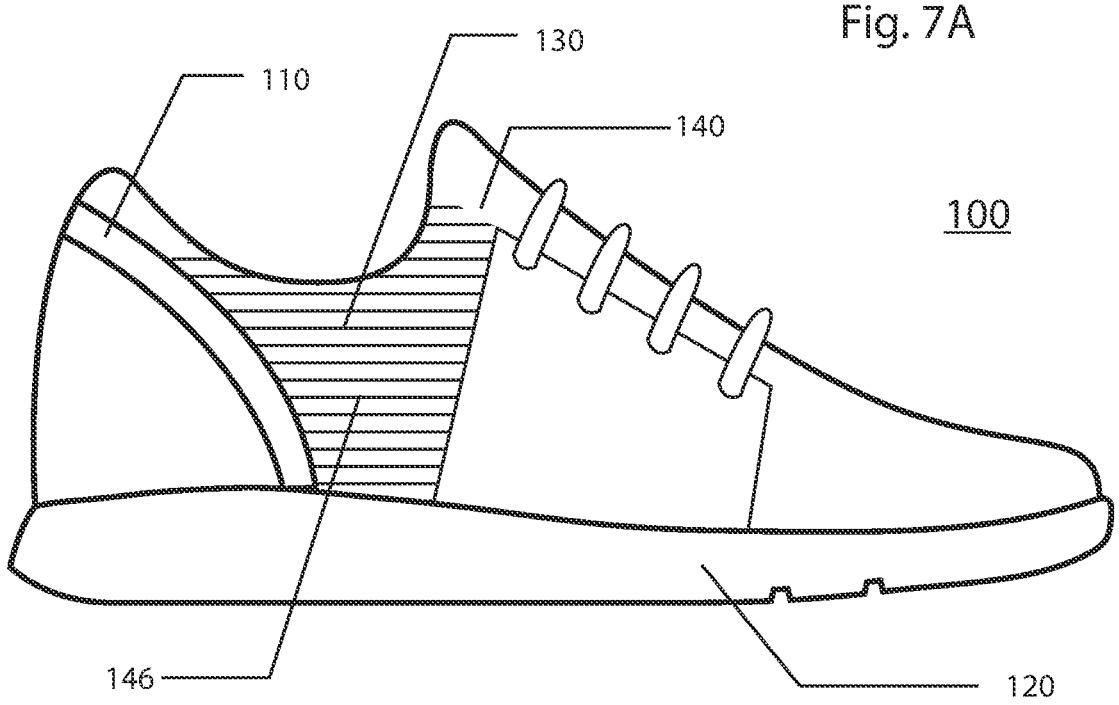
FIGS. 7A and 7B illustrate a rapid-entry shoe having a resilient upper, in uncollapsed and collapsed configurations, in accordance with various embodiments.
Figure 7B:
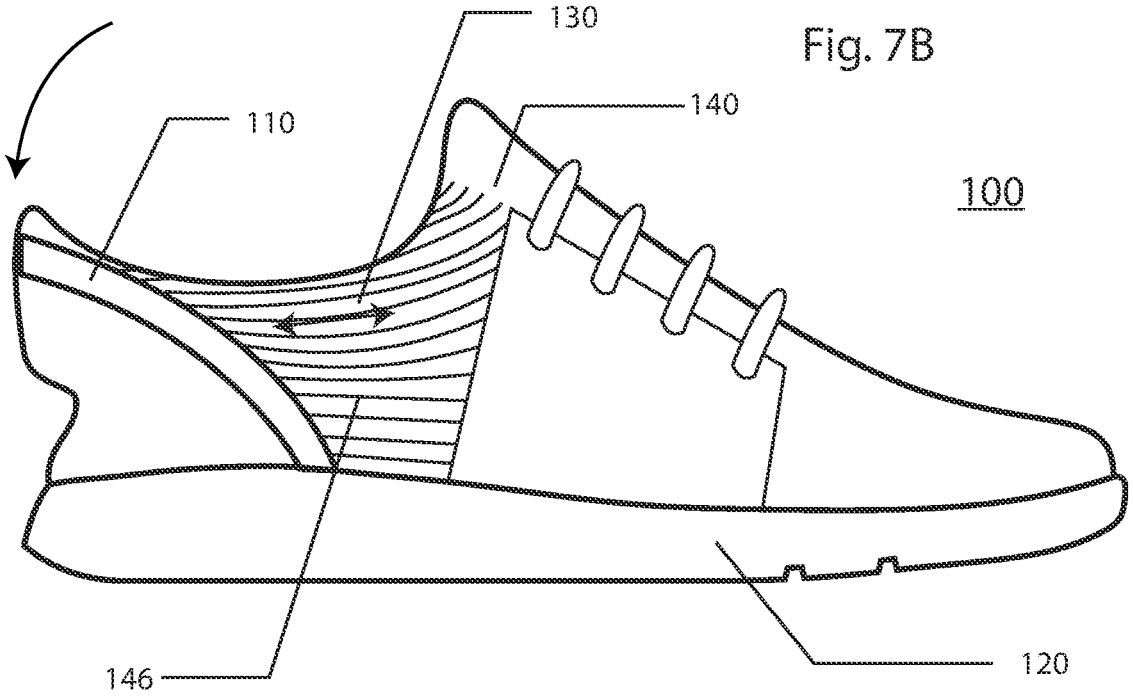

In this regard, and with reference to FIGS. 6A and 6B, the resilient member 130 may be used in connection with an upper 140. However, and with reference to FIGS. 7A and 7B, the resilient member 130 may comprised of an upper 140. That is, the upper 140 may itself be elastic and exert a forward and/or upward bias on the heel arm 110. In some embodiments, a distinct portion of the upper, e.g., an elastic gore 146, exerts a forward and/or upward bias on the heel arm 110.

Figure 8A:
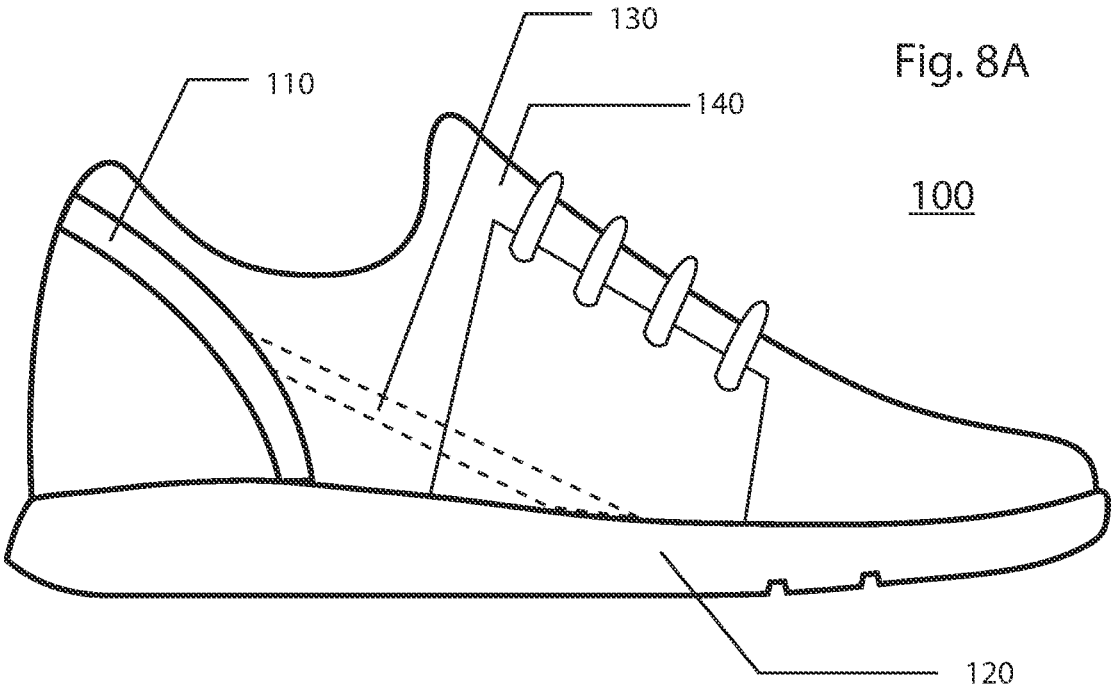
FIGS. 8A and 8B a rapid-entry shoe with a resilient member extending through an upper, in uncollapsed and collapsed configurations, in accordance with various embodiments.
Figure 8B:
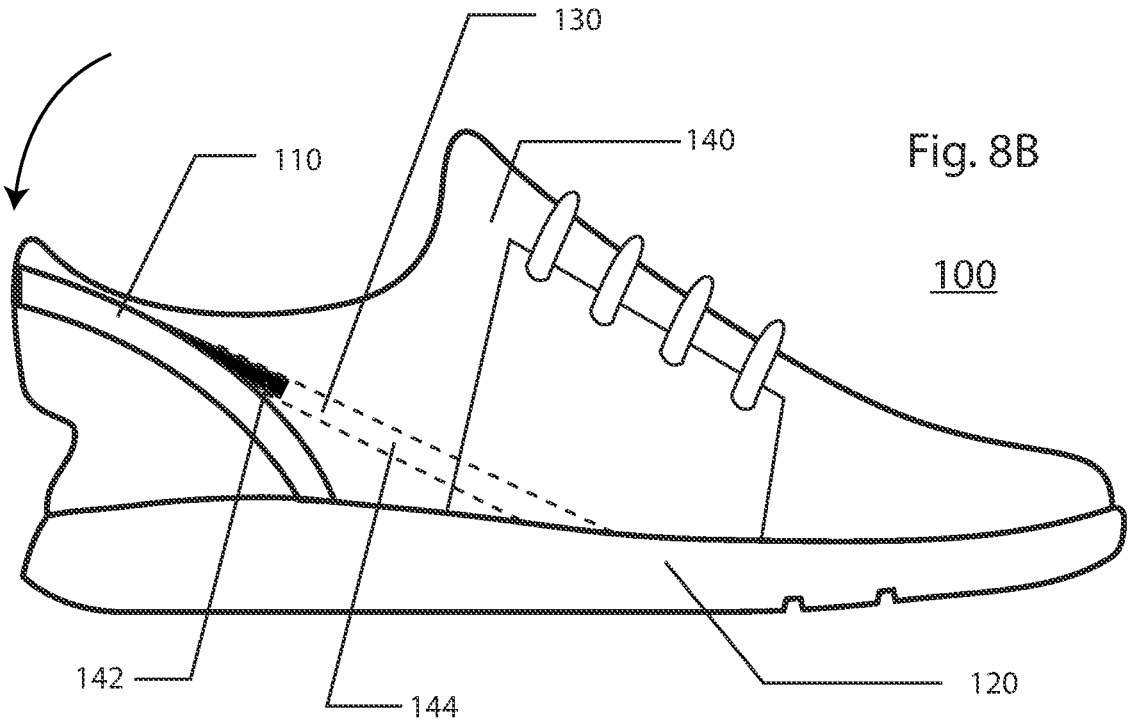

With reference to FIGS. 8A and 8B, the resilient member 130 may pass from outside an upper 140 to between layers of the upper 140 and/or to inside the upper 140. In this regard, the upper 140 may comprise an opening 142 to receive the resilient member 130 and may further comprise a sleeve 144 (e.g., at the dotted lines) to receive the resilient member 130. In this regard, the resilient member 130 can be configured to move independent of the upper 140.

In various embodiments, the heel arm 110 and the resilient member 130 comprise the same material. In various embodiments, the heel arm 110 and the resilient member 130 are integrally formed and are thus sections of a unitary element. In various embodiments, the heel arm 110 and the resilient member 130 are molded together.

With momentary reference back to FIGS. 1B and 1C, the heel arm 110 may have an arc shape or a horse-shoe shape, and thus may extend backward and upward from the rearward coupling point 115 to wrap around an upper rear portion of the rapid-entry shoe 100 (at or below the topline of the upper rear portion). In this regard, the heel arm 110 may comprise a heel section disposed between side two sections. The two side sections (e.g., a first side section and a second side section) may, in turn, be coupled to the base. That is, a first side section may be coupled to the base 120 at the rearward coupling point 115 and a second side section may be coupled to the base 120 at a rearward coupling point 116 on the opposite side of the rapid-entry shoe 100. In this regard, the heel arm 110 may extend continuously between opposing sides of base 120. In various embodiments, a forward coupling point 125 is located forward of the rearward coupling point 115, and a forward coupling point 126 is located forward of the rearward coupling point 116. Thus, in various embodiments, resilient member 130 may be a first resilient member 130, and the rapid-entry shoe 100 may have a second resilient member 130, with the first and second resilient members 130 extending on opposite sides of the rapid-entry shoe 100. In various embodiments, the forward coupling points 125/126 are disposed on a forefoot portion or forward half of the shoe and the rearward coupling points 115/116 are disposed on a heel portion or rear half of the shoe.

Notwithstanding the foregoing, in various embodiments, the heel arm 110 may only extend along one side of the rapid-entry shoe 100, and thus the heel arm 110 may only be coupled to the base 120 on one side of the shoe 100. In such embodiments, the heel arm 110 may still include a heel section that wraps all or partially around an upper rear portion of the rapid-entry shoe 100 (despite not having a side section or other support on the opposing side). In various embodiments, the heel arm 110 may actually include two separable elements. For example, there may be a first heel arm 110 on one side (e.g., lateral side) of the shoe 100 and a second heel arm 110 on a second side (e.g., medial side) of the shoe 100.

In various embodiments, the rearward coupling point 115 (e.g., the location where the heel arm 110 is coupled to the base 120) does not move forward or backward. That is, the end of the heel arm 110 that extends from the base 120 does not move forward or backward along the shoe, but instead rotates or pivots about the rearward coupling point 115. Notwithstanding the foregoing, the present disclosure contemplates embodiments wherein one or both of the heel arm 110 and the resilient member 130 can be coupled either at a point that moves, or at a plurality of different coupling points.

In use, the heel arm(s) 110 may be biased toward an uncollapsed configuration by the resilient member(s) 130. In the uncollapsed configuration, heel arm 110 can secure a rear portion of rapid-entry shoe 100 about a user's heel. Said differently, in example embodiments, the heel arm(s) 110 may be collapsed downward (i.e., towards the base 120 of the rapid-entry shoe 100) to the collapsed configuration and the heel arm 110 may be returned upward (i.e., away from the base 120 of the rapid-entry shoe 100) to the uncollapsed configuration so as to extend around a user's heel. In various embodiments, while the compression of the heel arm 110 is greater in the collapsed configuration than in the uncollapsed configuration, the uncollapsed configuration of the heel arm 110 may still be at least partially compressed (i.e., preloaded compression) so as to be able to hold the rear portion of the rapid-entry shoe 100 about the heel of the user. For example, the rear portion of the shoe may hold or retain the heel arm 110 in the preloaded, uncollapsed configuration. In various embodiments, in the uncollapsed configuration the heel structure may be disposed in a more upright/vertical orientation and/or may have little to no compression.

As mentioned above, the heel arm 110 and resilient member 130 may be manufactured to be integral with or within finished shoes. In various embodiments, the heel arm 110 may be integrated within an upper rear portion of a shoe, or the heel arm 110 may be coupled to an exterior of an upper rear portion of a shoe. For example, the heel arm 110 may be coupled to or integrated within a heel or a heel cap, a heel counter or the like, or may be partially or fully exposed. In various embodiments, the heel arm 110 may be coupled to an exterior of an upper rear portion of the rapid-entry shoe 100, and connected to the lower portion of the shoe 100.

It will be apparent to those skilled in the art that various modifications and variations can be made in the present disclosure without departing from the spirit or scope of the disclosure.

Figure 9:
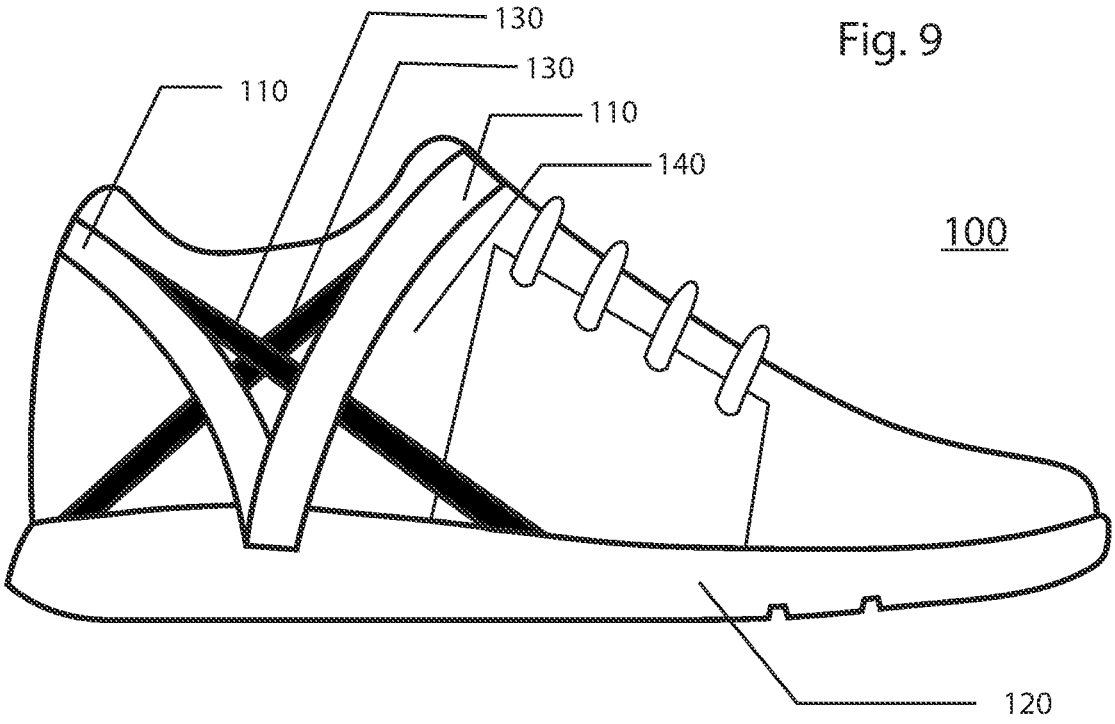
FIG. 9 illustrates a rapid entry shoe, in accordance with an example embodiment, having a plurality of heel arms.

As a non-limiting example, and with reference to FIG. 9, a plurality of heel arms 110 can cross or otherwise intersect or overlap one another and be pulled toward one another by their respective resilient members 130 coupled to the base 120 or the upper.

Figure 10:
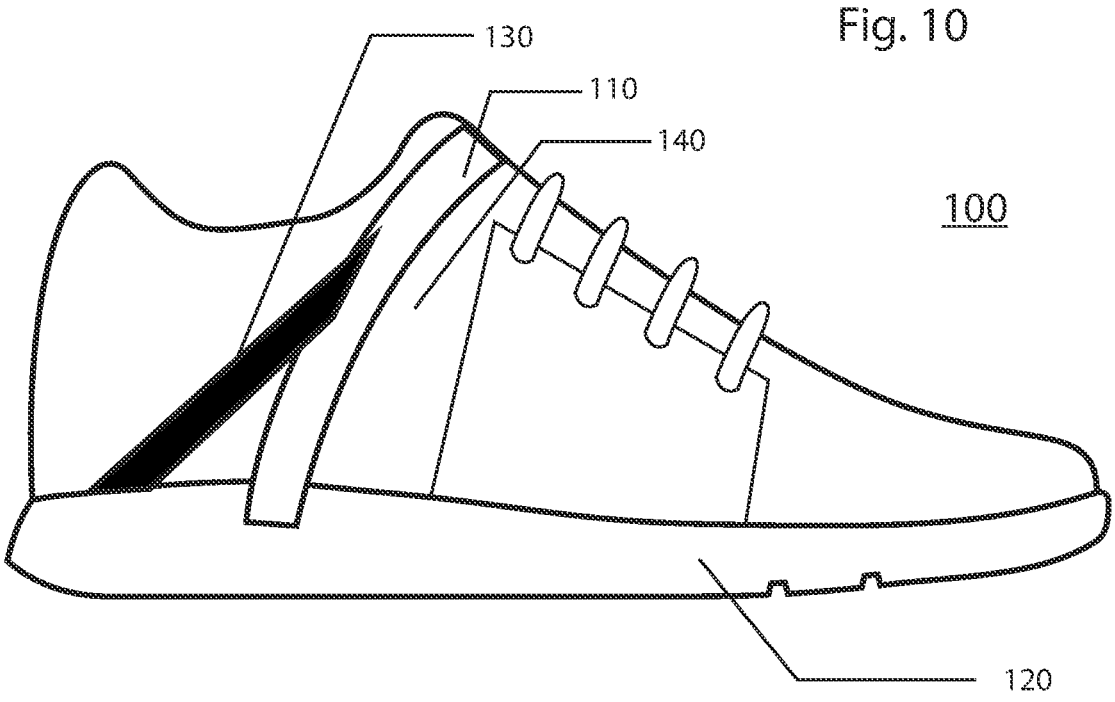
FIG. 10 illustrates a rapid-entry shoe having a heel arm and a resilient member, both angled upward toward the front portion, in accordance with various embodiments.

As another example, and with reference to FIG. 10, a rapid-entry shoe 100 can comprise a heel arm 110 and a resilient member 130, each angled upward from their respective coupling points toward the front portion of the shoe 100.

Figure 11A:
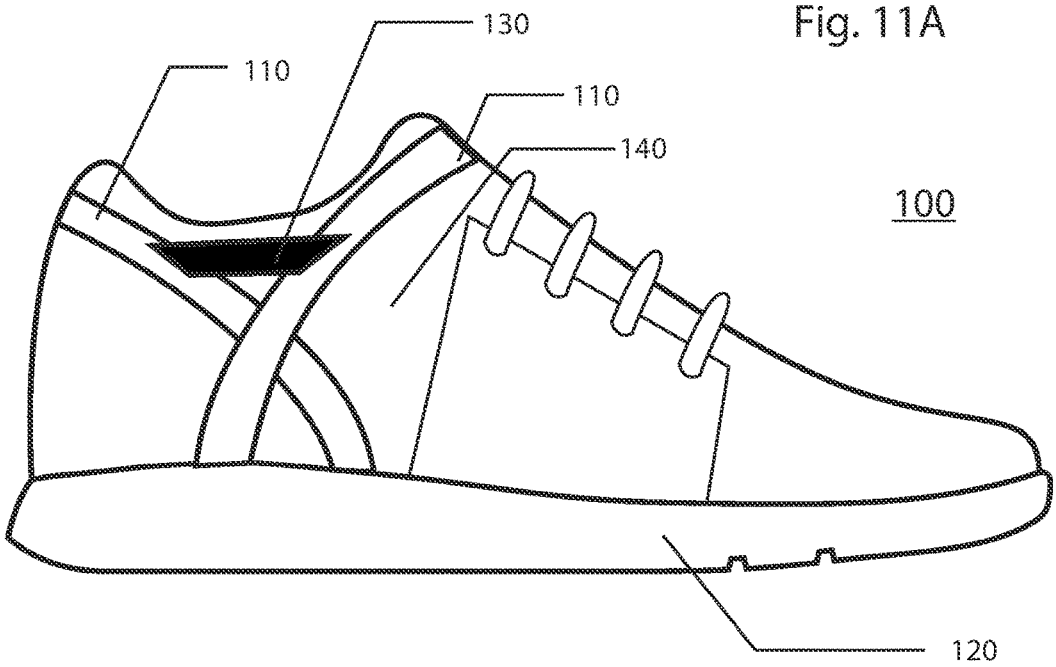
FIGS. 11A-11D illustrate additional rapid entry shoes, in accordance with additional example embodiments, having a plurality of heel arms.
Figure 11B:
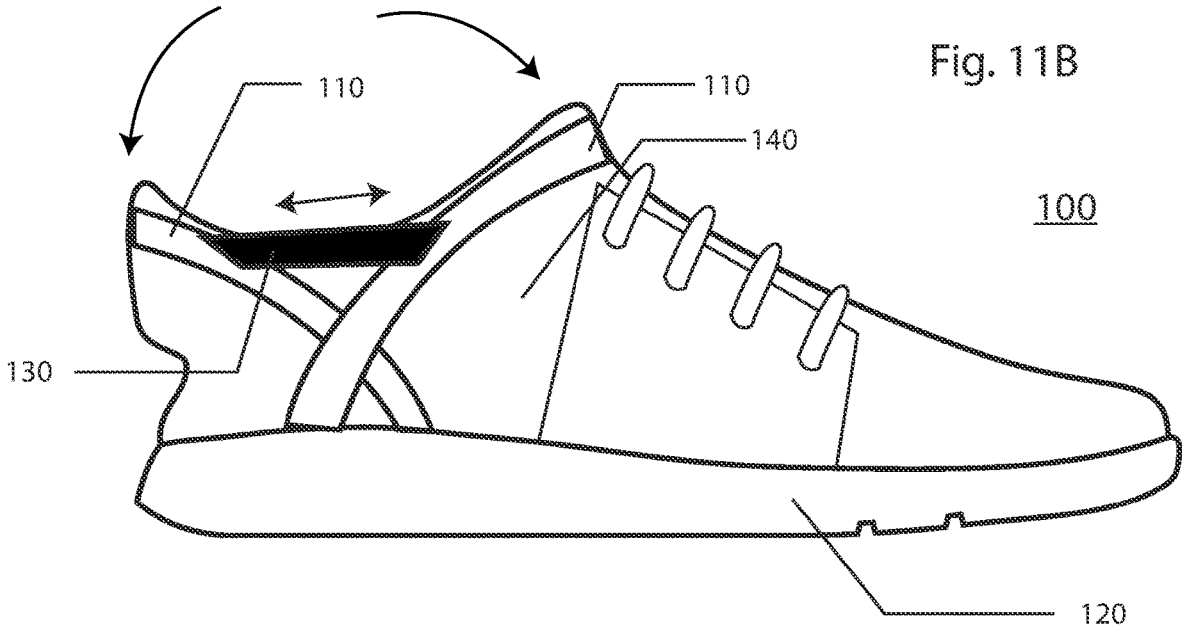
Figure 11C:
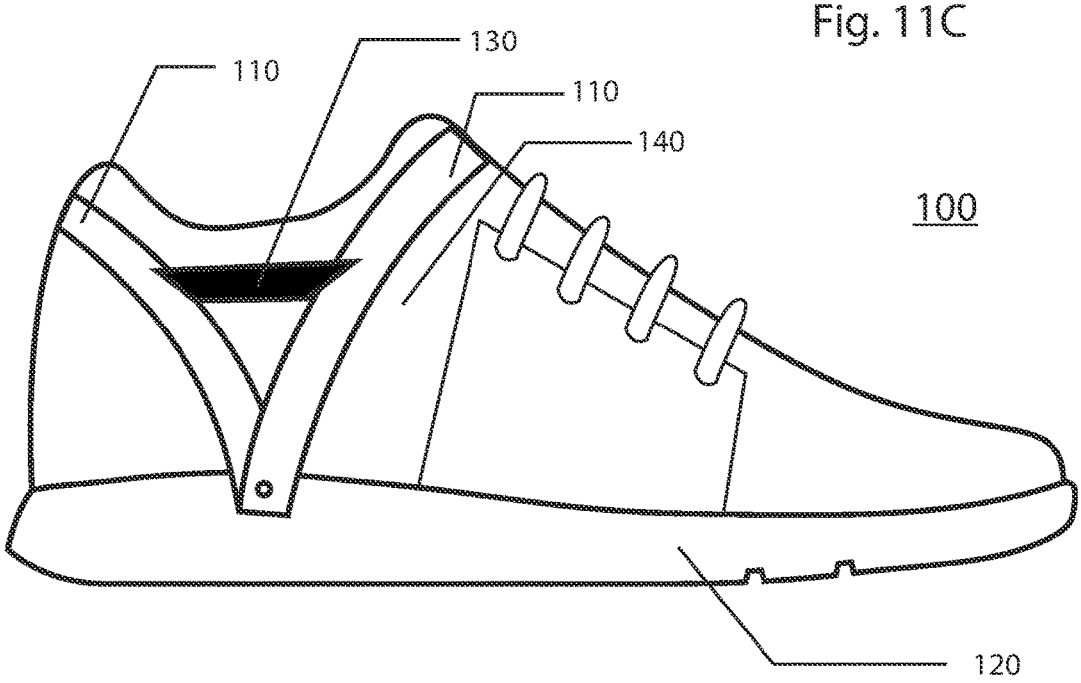
Figure 11D:
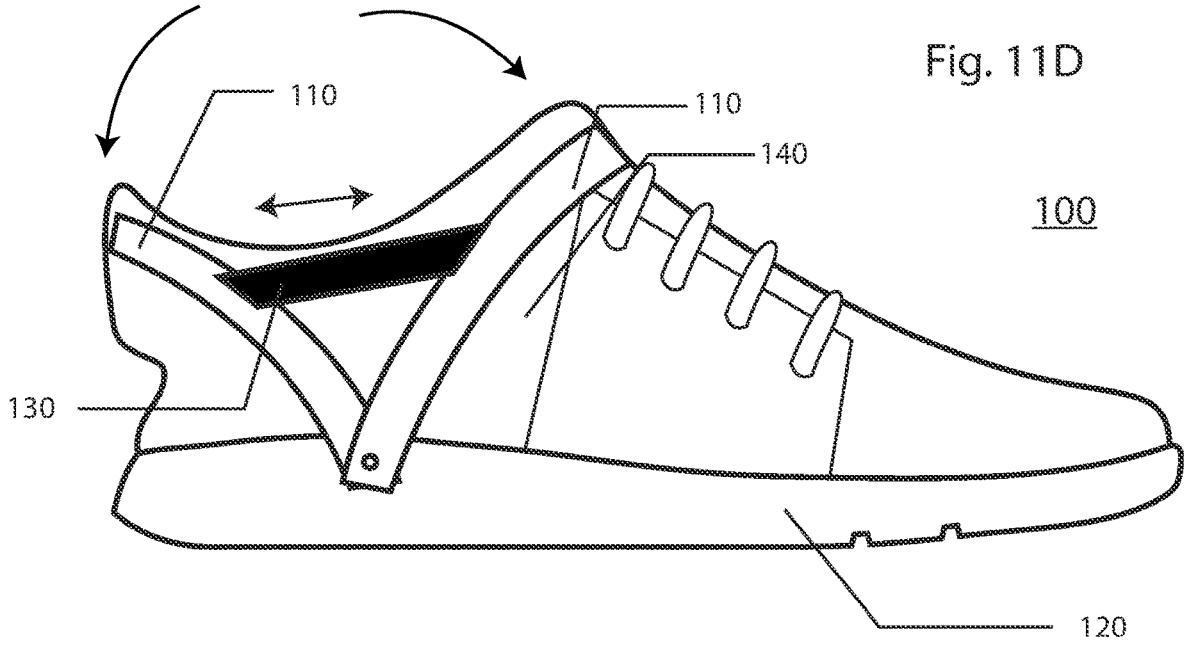

As yet another example, and with reference to FIGS. 11A-11D, a plurality of heel arms 110 can cross or otherwise intersect or overlap one another and be pulled toward one another by a single resilient member 130, the resilient member being attached exclusively to the heel arms (i.e., not to the 120 base or the upper 140). With reference to FIGS. 11A and 11B, the heel arms 110 can be attached to different coupling points on the base 120, for independent pivoting or rotation. Alternatively, and with reference to FIGS. 11C and 11D, the heel arms 110 can be attached to the same coupling point on the base 120, for common pivoting or rotation.

Figure 12A:
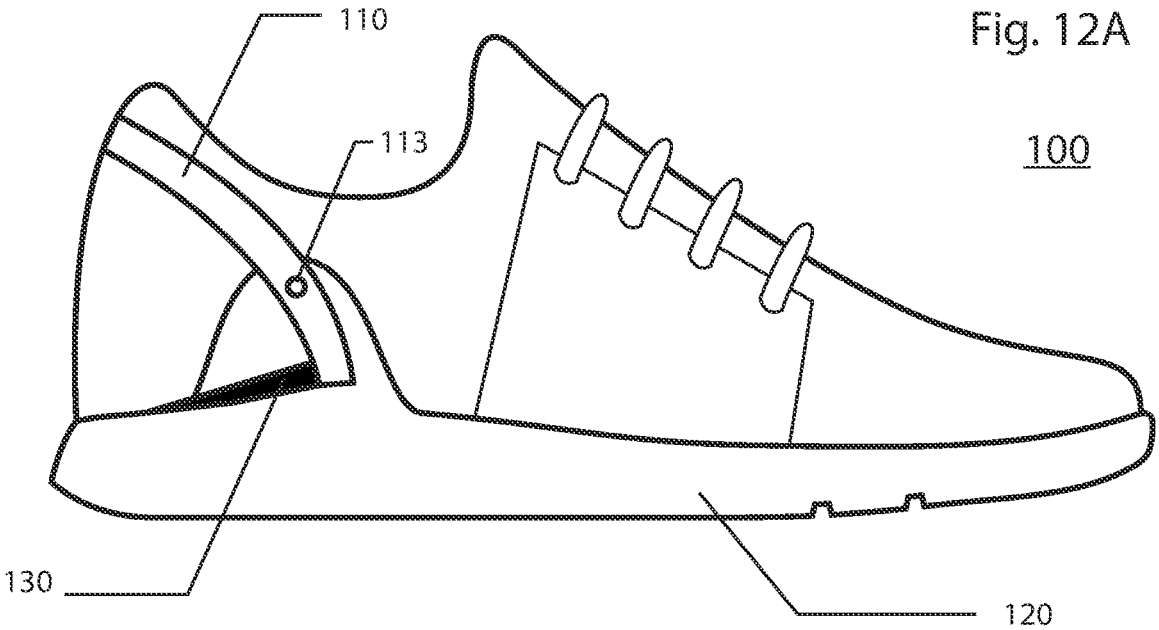
FIGS. 12A and 12B illustrate a rapid entry shoe, in accordance with example embodiments, wherein a heel arm is configured to pivot or rotate above a base.
Figure 12B:
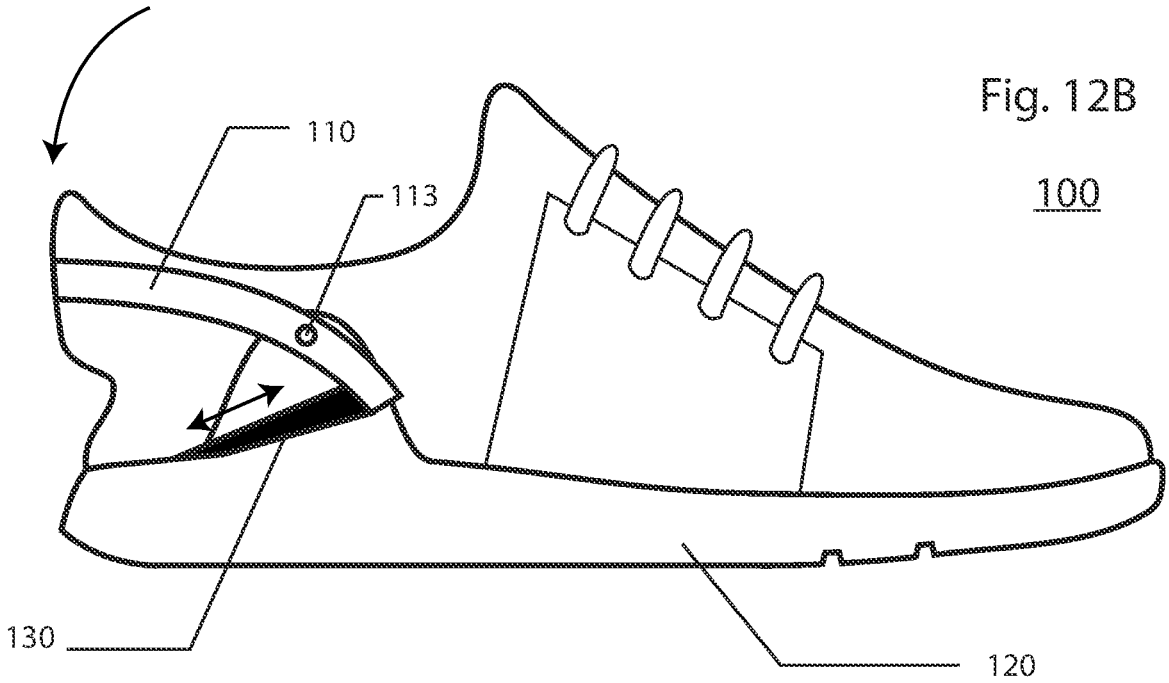

As still another example, and with reference to FIGS. 12A and 12B, a heel arm 110 can pivot or rotate at a coupling point 113 located above the base 120 and the heel arm 110 can be pulled toward an uncollapsed configuration by a resilient member 130 extending from the heel arm 110 rearward toward the base 120.

Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:

a base;

an upper;

a heel arm coupled to the base or the upper at a rear portion of the rapid-entry shoe; and a resilient member coupled to a side portion of the rapid-entry shoe, wherein the heel arm comprises an open arc shape coupled to opposing sides of the rapid-entry shoe, wherein the heel arm is configured to transition between a collapsed configuration and an uncollapsed configuration, wherein in the collapsed configuration the heel arm is deformed or rotated downward or rearward, wherein the resilient member is coupled to the heel arm at a heel arm coupling point and is coupled to the base or the upper at a forward coupling point, wherein the resilient member is configured to stretch independently past an overlying or underlying portion of the upper, and wherein the resilient member exerts an upward force on the heel arm to bias the heel arm toward the uncollapsed configuration.

2. The rapid-entry shoe of claim 1, wherein the heel arm is comprised of a rigid material that maintains its shape between the collapsed configuration and the uncollapsed configuration so does not bias the heel arm toward the uncollapsed configuration.

3. The rapid-entry shoe of claim 1, wherein the heel arm is comprised of a semi-rigid material that resiliently deforms between the collapsed configuration and the uncollapsed configuration to further bias the heel arm toward the uncollapsed configuration.

4. The rapid-entry shoe of claim 1, wherein an interface between the heel arm and the base is a living hinge.

5. The rapid-entry shoe of claim 1, wherein in the uncollapsed configuration, an angle measured between the heel arm and the base is greater than an angle measured between the resilient member and the base.

6. The rapid-entry shoe of claim 5, wherein a difference in an uncollapsed configuration of the angle measured between the heel arm and the base and the angle measured between the resilient member and the base is greater than the difference in a collapsed configuration of the angle measured between the heel arm and the base and the angle measured between the resilient member and the base.

7. A rapid-entry shoe comprising:

a base;

an upper coupled to the base;

a heel arm coupled to the base or the upper at a rear portion of the rapid-entry shoe; and a resilient member coupled to the base or the upper, wherein the resilient member is embedded beneath a layer of the upper, wherein the heel arm comprises an open arc shape coupled to opposing sides of the base or the upper, wherein the heel arm is configured to transition between a collapsed configuration and an uncollapsed configuration, wherein in the collapsed configuration the heel arm is deformed or rotated downward or rearward, wherein the resilient member is coupled to the heel arm at a heel arm coupling point and is coupled to the base or the upper at a forward coupling point, and wherein the resilient member exerts an upward force on the heel arm to bias the heel arm toward the uncollapsed configuration.

8. The rapid-entry shoe of claim 7, wherein the heel arm is comprised of a rigid material that maintains its shape between the collapsed configuration and the uncollapsed configuration so does not bias the heel arm toward the uncollapsed configuration.

9. The rapid-entry shoe of claim 7, wherein the heel arm is comprised of a semi-rigid material that resiliently deforms between the collapsed configuration and the uncollapsed configuration to further bias the heel arm toward the uncollapsed configuration.

10. The rapid-entry shoe of claim 7, wherein an interface between the heel arm and the base is a living hinge.

11. The rapid-entry shoe of claim 7, wherein the resilient member is comprised of a portion of the upper.

12. A rapid-entry shoe comprising:

a base;

an upper;

a heel arm having an open arc shape; and a resilient member, wherein the heel arm comprises a heel section disposed between a medial side section and a lateral side section, wherein the medial side section is coupled to the base or the upper at a medial rearward coupling point and the lateral side section is coupled to the base or the upper at a lateral rearward coupling point, wherein the resilient member is coupled to the heel arm at a heel arm coupling point and is further coupled to the base or the upper at a forward coupling point, wherein a length of the heel arm below the heel arm coupling point is free from the resilient member, wherein the heel arm is configured to transition between a first configuration for donning and doffing of the shoe and an second configuration for securing a foot inside the shoe, wherein in the first configuration the heel arm is deformed or rotated downward or rearward, and wherein the resilient member is configured to bias the heel arm toward the second configuration.

13. The rapid-entry shoe of claim 12, wherein the heel arm is comprised of a rigid material that maintains its shape between the first configuration and the second configuration so does not bias the heel arm toward the second configuration.

14. The rapid-entry shoe of claim 12, wherein the heel arm is comprised of a semi-rigid material that resiliently deforms between the first configuration and the second configuration to further bias the heel arm toward the second configuration.

15. The rapid-entry shoe of claim 12, wherein an interface between the heel arm and the base is a living hinge.

16. The rapid-entry shoe of claim 12, wherein the resilient member is comprised of a portion of the upper.

* * * * *